US008159400B2

(12) United States Patent
Han et al.

(10) Patent No.: US 8,159,400 B2
(45) **Date of Patent: *Apr. 17, 2012**

(54) CHIP ANTENNA AND MOBILE-COMMUNICATION TERMINAL HAVING THE SAME

(75) Inventors: Chang Mok Han, Chungcheongnam-Do (KR); Ki Won Chang, Gyunggi-Do (KR); Duk Woo Lee, Gyunggi-Do (KR); Dae Kyu Lee, Gyunggi-Do (KR); Jeong Sik Seo, Gyunggi-Do (KR); Hyun Do Park, Gyunggi-Do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 635 days.

This patent is subject to a terminal disclaimer.

(21) Appl. No.: 12/170,999

(22) Filed: Jul. 10, 2008

(65) Prior Publication Data

US 2009/0015486 A1 Jan. 15, 2009

(30) Foreign Application Priority Data

Jul. 12, 2007 (KR) ..... 10-2007-0070046

(51) Int. Cl.
*H01Q 1/24* (2006.01)
*H01Q 1/38* (2006.01)

(52) U.S. Cl. ..... 343/702

(58) Field of Classification Search ..... 343/700 MS, 343/702, 846, 860

See application file for complete search history.

(56) References Cited

U.S. PATENT DOCUMENTS

| | | | | |
|---|---|---|---|---|
| 6,297,777 | B1 * | 10/2001 | Tsubaki et al. | 343/700 MS |
| 6,614,398 | B2 | 9/2003 | Kushihi et al. | |
| 7,479,928 | B2 | 1/2009 | Tan et al. | |
| 7,791,541 | B2 * | 9/2010 | Chang et al. | 343/700 MS |
| 2003/0001785 | A1 | 1/2003 | Park | |
| 2006/0049988 | A1 | 3/2006 | Kim et al. | |

(Continued)

FOREIGN PATENT DOCUMENTS

DE 10163936 1/2003

(Continued)

OTHER PUBLICATIONS

German Office Action for Application No. 10 2008 031 936.8 mailed Dec. 15, 2010.

(Continued)

*Primary Examiner* — Michael C Wimer

(74) *Attorney, Agent, or Firm* — Lowe, Hauptman, Ham & Berner, LLP

(57) ABSTRACT

There are provided a chip antenna and a mobile telecommunication terminal having the chip antenna. The chip antenna includes: a dielectric block having opposing top and bottom surfaces and a plurality of side surfaces connecting the top and bottom surfaces; a first conductive pattern formed on at least one of the surfaces of the dielectric block and connected to an external feeding part; a second conductive pattern formed on at least one of the surfaces of the dielectric block to connect to the first conductive pattern, and having one end connected to an external ground part; and a third conductive pattern formed on at least one of the surfaces of the dielectric block, and spaced apart from the first and second conductive patterns to be capacitively coupled to the first and second conductive patterns, respectively, the third conductive pattern having a lower end connected to the external ground part.

22 Claims, 5 Drawing Sheets

U.S. PATENT DOCUMENTS

| | | | |
|---|---|---|---|
| 2006/0192712 | A1 | 8/2006 | Park et al. |
| 2007/0040749 | A1 | 2/2007 | Jeon et al. |

FOREIGN PATENT DOCUMENTS

| | | | |
|---|---|---|---|
| DE | 102004052763 | | 3/2006 |
| DE | 102005060138 | | 9/2006 |
| EP | 1063722 | | 12/2000 |
| EP | 1538701 | | 6/2005 |
| EP | 1892799 | | 2/2008 |
| JP | 2005-167762 | A | 6/2005 |
| JP | 2006-340368 | A | 12/2006 |
| WO | 2006000631 | | 1/2006 |

OTHER PUBLICATIONS

Office Action for U.S. Appl. No. 11/944,575 mailed Mar. 30, 2011.
Office Action for U.S. Appl. No. 11/944,573 mailed Apr. 12, 2011.

* cited by examiner

CHIP ANTENNA AND MOBILE-COMMUNICATION TERMINAL HAVING THE SAME

CROSS-REFERENCE TO RELATED APPLICATIONS

This application claims the priority of Korean Patent Application No. 2007-70046 filed on Jul. 12, 2007, in the Korean Intellectual Property Office, the disclosure of which is incorporated herein by reference.

BACKGROUND OF THE INVENTION

1. Field of the Invention

The present invention relates to a chip antenna and a mobile telecommunication terminal having the chip antenna, and more particularly, to a chip antenna including one conductive pattern connected to a feeding part and a ground part, and another conductive pattern capacitively coupled to the one conductive pattern and connected to the ground part, and a mobile communication terminal having the chip antenna.

2. Description of the Related Art

In a mobile telecommunication field, an antenna is a passive device whose characteristics are susceptible to ambient environment. The antenna is installed in a base station, or attached to a relay device or a wireless telecommunication device. The antenna receives an electric wave from the outside or transmits an electrical signal generated from a telecommunication device, to the outside.

A chip antenna assembled inside the mobile telecommunication terminal requires each terminal to be optimized in characteristics such as standing wave ratio (SWR) matching. A narrower bandwidth of the chip antenna necessitates a greater number of experiments for optimization. On the other hand, a broader bandwidth of the chip antenna decreases the number of experiments, thereby shortening development time.

In a conventional chip antenna, a radiation pattern is formed on a dielectric block to connect to a feeding part and a ground part, accordingly requiring an electromagnetic coupling feeding structure and a radiator to be designed for a specific frequency band. However, there have been limitations in designing the chip antenna with broadband characteristics by virtue of such a feeding structure.

In addition, the chip antenna, when assembled inside the mobile telecommunication terminal, is altered in frequency characteristics, inevitably entailing a tuning process thereof. This tuning process brings about a change in design of an antenna pattern or dielectric block, thereby degrading manufacturing efficiency.

SUMMARY OF THE INVENTION

An aspect of the present invention provides a chip antenna having broadband frequency characteristics and a superior voltage standing wave ratio (VSWR) in a broadband frequency range, and a mobile telecommunication terminal including a board having a ground pattern used for tuning a resonant frequency when the antenna is assembled inside the mobile telecommunication terminal.

According to an aspect of the present invention, there is provided a chip antenna including: a dielectric block having opposing top and bottom surfaces and a plurality of side surfaces connecting the top and bottom surfaces; a first conductive pattern formed on at least one of the surfaces of the dielectric block and connected to an external feeding part; a second conductive pattern formed on at least one of the surfaces of the dielectric block to connect to the first conductive pattern, and having one end connected to an external ground part; and a third conductive pattern formed on at least one of the surfaces of the dielectric block, and spaced apart from the first and second conductive patterns at a predetermined distance to be capacitively coupled to the first and second conductive patterns, respectively, the third conductive pattern having a lower end connected to the external ground part.

The dielectric block may be shaped as a rectangular parallelepiped.

The first and second conductive patterns may define a radiator, wherein the radiator is formed across a first side surface parallel to a longitudinal direction of the dielectric block, the top surface and a second side surface opposing the first side surface of the dielectric block.

The first conductive pattern may be formed on the first side surface parallel to a longitudinal direction of the dielectric block.

The first conductive pattern may have an upper end in contact with an intersecting line between the first side surface and the top surface of the dielectric block. The first conductive pattern may be L-shaped.

The second conductive pattern may be formed on the second side surface opposing the first side surface and the top surface of the dielectric block.

The second conductive pattern may include a contact portion of a predetermined length in contact with the first conductive pattern, and the other portion of the second conductive pattern excluding the contact portion is spaced apart from the first conductive pattern at a predetermined distance.

The third conductive pattern may be formed on the bottom surface of the dielectric block. The third conductive pattern may have a lower end in contact with an intersecting line between the bottom surface and the first side surface of the dielectric block, and has at least one bending.

The chip first conductive pattern may be formed on the first side surface of the dielectric block and has an L shape such that an upper end of the first conductive pattern is in contact with an intersecting line between the first side surface and the top surface of the dielectric block, the second conductive pattern is formed at a predetermined distance from an intersecting line between the top surface and the first side surface of the dielectric block, excluding a contact portion in contact with the first conductive pattern, and the third conductive pattern is formed on the bottom surface of the dielectric block and has a lower end in contact with an intersecting line between the bottom surface and the first side surface of the dielectric block, and has one bending.

According to another aspect of the present invention, there is provided a mobile telecommunication terminal including: a chip antenna including: a dielectric block having opposing top and bottom surfaces and a plurality of side surfaces connecting the top and bottom surfaces; a first conductive pattern formed on at least one of the surfaces of the dielectric block and connected to an external feeding part; a second conductive pattern formed on at least one of the surfaces of the dielectric block to connect to the first conductive pattern, and having one end connected to an external ground part; and a third conductive pattern formed on at least one of the surfaces of the dielectric block, and spaced apart from the first and second conductive patterns at a predetermined distance to be capacitively coupled to the first and second conductive patterns, respectively, the third conductive pattern having a lower end connected to the external ground part; and a printed circuit board having the chip antenna mounted on one surface thereof, the printed circuit board including a tuning ground pattern formed on another surface opposing the one surface of the printed circuit board and having one end connected to a ground part to be used for tuning frequency characteristics of the chip antenna.

The tuning ground pattern may have an open-square shape defined along an edge of a portion corresponding to a mounting area of the chip antenna.

The tuning ground pattern may have ruler markings to facilitate tuning.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1A:
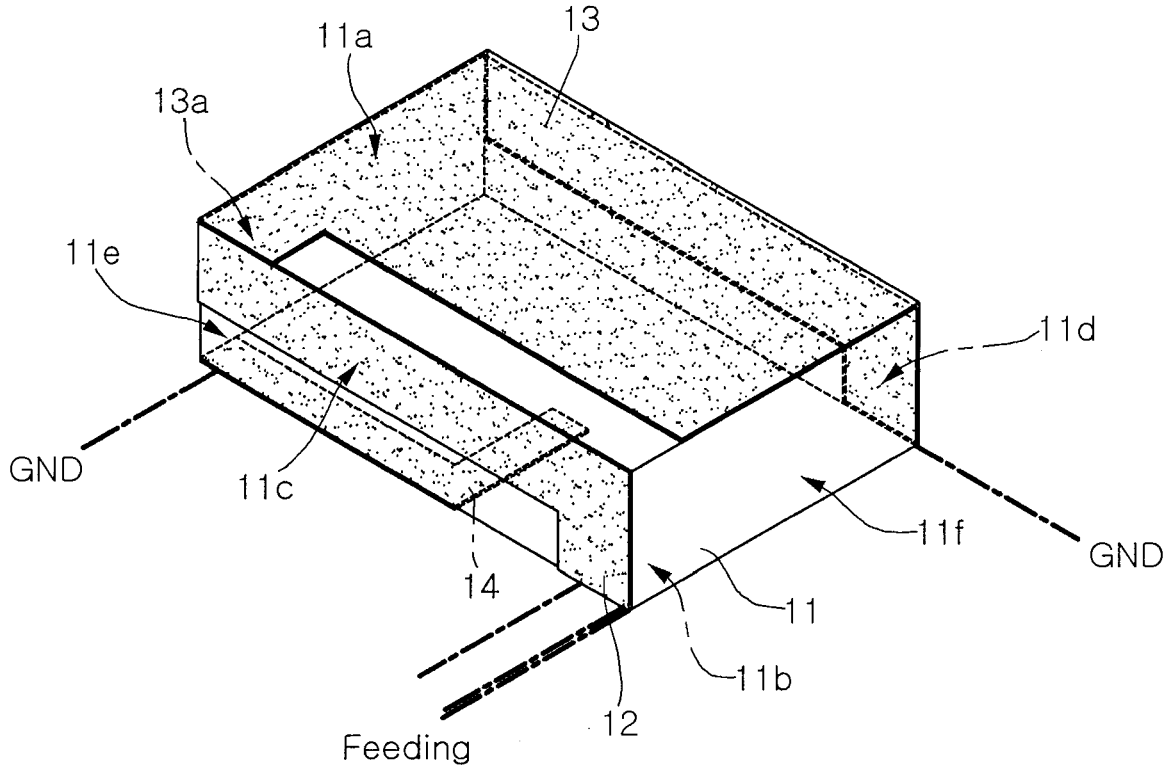
FIG. 1A is a perspective view and FIG. 1B is a development view illustrating a chip antenna according to an exemplary embodiment of the invention.
Figure 1B:
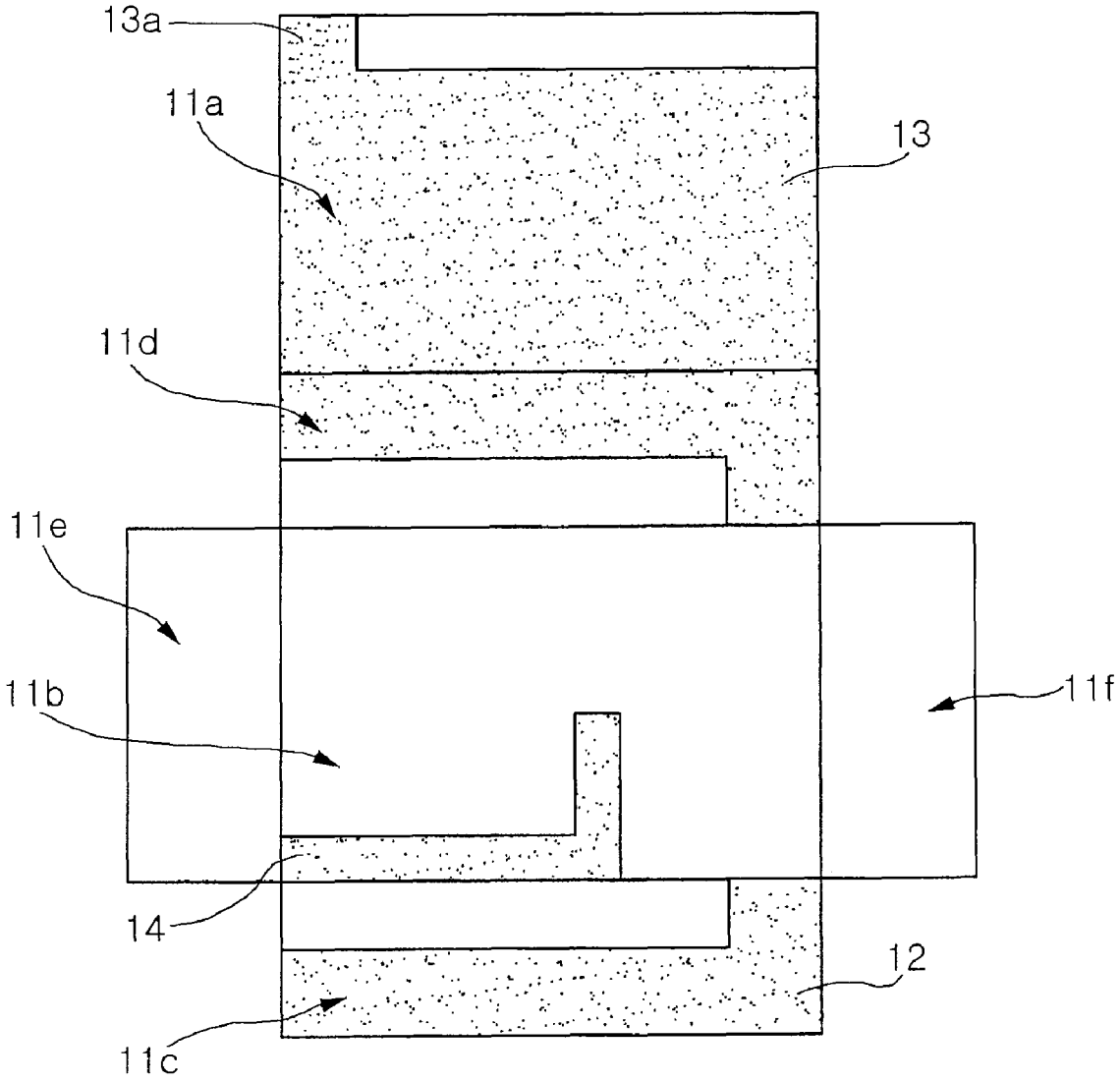

FIG. 1A is a perspective view and FIG. 1B is a development view illustrating a chip antenna according to an exemplary embodiment of the invention.

Referring to FIGS. 1A and 1B, the chip antenna of the present embodiment includes a dielectric block 11, a first conductive pattern 12, a second conductive pattern 13 and a third conductive pattern 14.

The dielectric block 11 may be shaped as a rectangular parallelepiped. The dielectric block 11 has a top surface 11*a* and a bottom surface 11*b* opposing each other, and first to fourth side surfaces 11*c*, 11*d*, 11*e*, and 11*f* connecting the top surface 11*a* and the bottom surface 11*b*. The bottom surface 11*b* of the dielectric block may be brought in contact with a board when the antenna is mounted on the board.

A first conductive pattern 12 and a second conductive pattern 13 are connected to each other on the first side surface 11*c*, top surface 11*a*, and second side surface 11*d* of the dielectric block 11 to define one radiator.

The first conductive pattern 12 has one end connected to an external feeding part to provide a signal to the radiator. The second conductive pattern 13 is connected to the first conductive pattern 12 and has one end connected to an external ground part. A portion 13*a* of the second conductive pattern may be in contact with the first conductive pattern 12. The first conductive pattern 12 and the second conductive pattern 13 can act as a radiator of the antenna.

To utilize outer surfaces of the dielectric block of a rectangular parallelepiped shape with the greatest efficiency, the radiator defined by the first conductive pattern 12 and the second conductive pattern 13 may be formed across the first side surface 11*c*, the top surface 11*a* and the second side surface 11*d* of the dielectric block.

In the present embodiment, the first conductive pattern 12 is formed on the first side surface 11*c* parallel to a longitudinal direction of the dielectric block. The second conductive pattern 13 is formed across the second side surface 11*d* and the top surface 11*a* of the dielectric block.

The first conductive pattern 12 is L-shaped. With such a shape, the first conductive pattern 12 can be spaced apart at a predetermined distance from a ground part of a board where the chip antenna is mounted, thereby allowing one end of the first conductive pattern 12 to be connected to an external feeding part. A portion of the first conductive pattern 12 may be in contact with an intersecting line between the first side surface 11*c* and the top surface 11*a* of the dielectric block.

Therefore, the first conductive pattern 12 and the second conductive pattern 13 act as the radiator of the antenna. Meanwhile, the third conductive pattern 14 serves to alter impedance characteristics of the antenna by capacitive coupling with the first and second conductive patterns, respectively. The magnitude of capacitive coupling may be controlled by adjusting a spacing of the conductive patterns from one another or an area adjacent to one another.

In the present embodiment, the first conductive pattern 12 is L-shaped and has an upper end in contact with the intersecting line between the first side surface 11*c* and the top surface 11*a* of the dielectric block. This is designed to adjust the magnitude of capacitive coupling between the first and second conductive patterns and the third conductive pattern, respectively.

The second conductive pattern 13 may be extended to the second side surface 11*d* and the top surface 11*a* of the dielectric block 11. A portion of the second conductive pattern 13 formed on the second side surface 11*d* of the dielectric block 11 may correspond to the first conductive pattern 12. Also, in the second conductive pattern formed on the top surface 11*a* of the dielectric block 11, the portion 13*a* in contact with the first conductive pattern 12 may be extended to the intersecting line between the first side surface 11*c* and the top surface 11*a* of the dielectric block 11. The other portion of the second conductive pattern excluding the portion 13*a* in contact with the first conductive pattern 12 may be spaced apart at a predetermined distance from the intersecting line between the first side surface 11*a* and the top surface 11*a* of the dielectric block 11. The second conductive pattern 13 has a width equal to a width of the first conductive pattern 12.

The contact portion 13*a* between the second conductive pattern 13 and the first conductive pattern 12 may have a width varied. A portion where the contact portion 13*a* is in contact with the first conductive pattern 12 may be varied in length to change antenna characteristics.

The first conductive pattern 12 has one end connected to the feeding part to receive a signal from the outside, and the second conductive pattern 13 has one end connected to the ground part.

The signal inputted from the outside is fed to the second conductive pattern 13 connected to the first conductive pattern 12 so that the first conductive pattern 12 and the second conductive pattern 13 can operate as the radiator of the antenna.

The first conductive pattern and second conductive pattern may be configured variously as long as they are formed on three surfaces of the rectangular parallelepiped-shaped dielectric block. That is, the first conductive pattern and the second conductive pattern may have the contact portion 13*a* therebetween formed on one of the first side surface 11*c* and the second side surface 11*d* of the dielectric block.

A third conductive pattern 14 is formed on the bottom surface 11*b* of the dielectric block 11, and has a lower end connected to an external ground part.

The third conductive pattern 14 is capacitively coupled to the first conductive pattern 12 and the second conductive pattern 13, respectively to enable impedance matching of the antenna.

The third conductive pattern 14 can be varied in length to adjust overall impedance matching of the antenna. That is, with a smaller length of the third conductive pattern 14, the antenna has a higher resonant frequency. On the other hand, with a greater length of the third conductive pattern 14, the antenna has a lower resonant frequency.

The third conductive pattern 14 may have the lower end in contact with an intersecting line between the bottom surface 11*b* and the first side surface 11*c* of the dielectric block. The third conductive pattern 14 may have at least one bending formed thereon to secure a predetermined length.

Figure 2A:
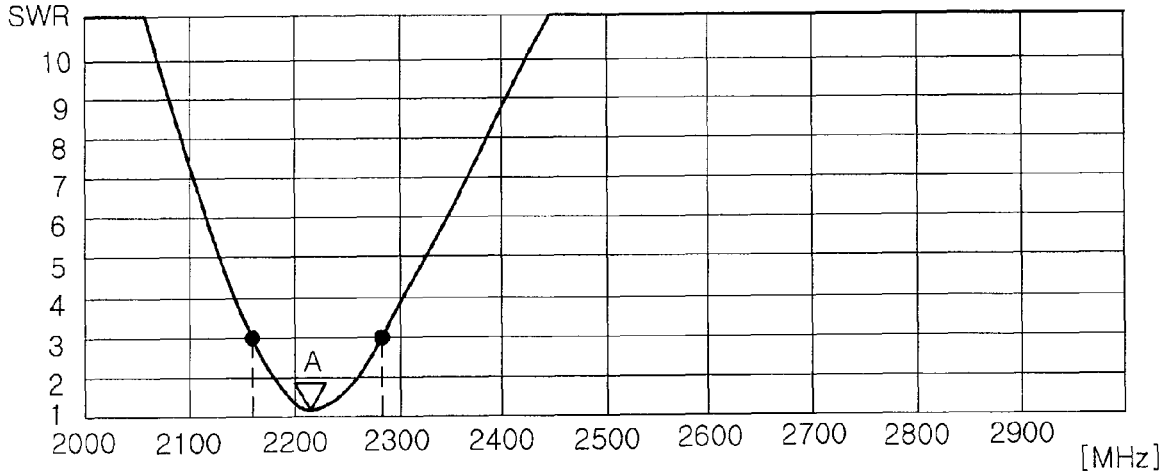
FIGS. 2A and 2B are a graph illustrating voltage standing wave ratio (VSWR) characteristics and a smith chart of the chip antenna shown in FIG. 1, respectively.
Figure 2B:
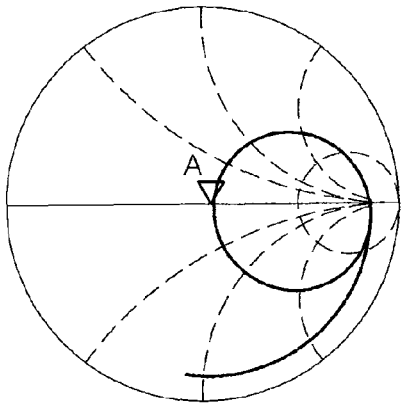

FIGS. 2A and 2B are a graph illustrating voltage standing wave ratio (VSWR) characteristics and a smith chart of the chip antenna shown in FIG. 1, respectively.

In the graph of FIG. 2A, an x axis denotes frequency (MHz) and a y axis denotes VSWR.

Here, the VSWR denotes a ratio between an output signal and a reflection signal of the antenna. The VSWR is optimal when 1, which indicates no presence of reflected waves. Meanwhile, the VSWR of 3 or more does not ensure the antenna characteristics.

In the present embodiment, a chip antenna having first to third conductive patterns formed on a ceramic dielectric block with a size of 6×2×1.5 [$mm^3$] is mounted on a test printed circuit board (PCB) made of FR4 and with a size of 40×40×1.0 [$mm^3$]. Then, VSWR is measured.

In the present embodiment, as shown in FIG. 2A, the VSWR is plotted at 3 or less when the antenna has a frequency ranging from 2160 to 2280 [MHz]. Thus, the VSWR is shown superior in a bandwidth of about 120 [MHz]. A frequency (A) having the most superior VSWR is a resonant frequency, which is about 2220 [MHz] in the present embodiment.

In a case of adopting the antenna of FIG. 1 without the third conductive pattern 14 formed thereon, the VSWR characteristics may be shown to be poorer than the present embodiment. That is, in the VSWR graph, a curve may be shifted upward overall, thereby narrowing a frequency band when the VSWR is identical, compared with the present embodiment.

In the present embodiment, the third conductive pattern is formed to be capacitively coupled to a radiation pattern of the antenna to further ensure overall impedance matching of the antenna, thereby realizing a chip antenna with broadband characteristics and excellent antenna characteristics in a broadband frequency range.

FIG. 2B is a smith chart of the chip antenna shown in FIG. 2B. In the smith chart graph, with a bigger impedance circle, the chip antenna is less susceptible to ground conditions of the board where the chip antenna is mounted. In the present embodiment, in the resonant frequency A, the impedance circle of the chip antenna is plotted in the vicinity of 50Ω.

Figure 3A:
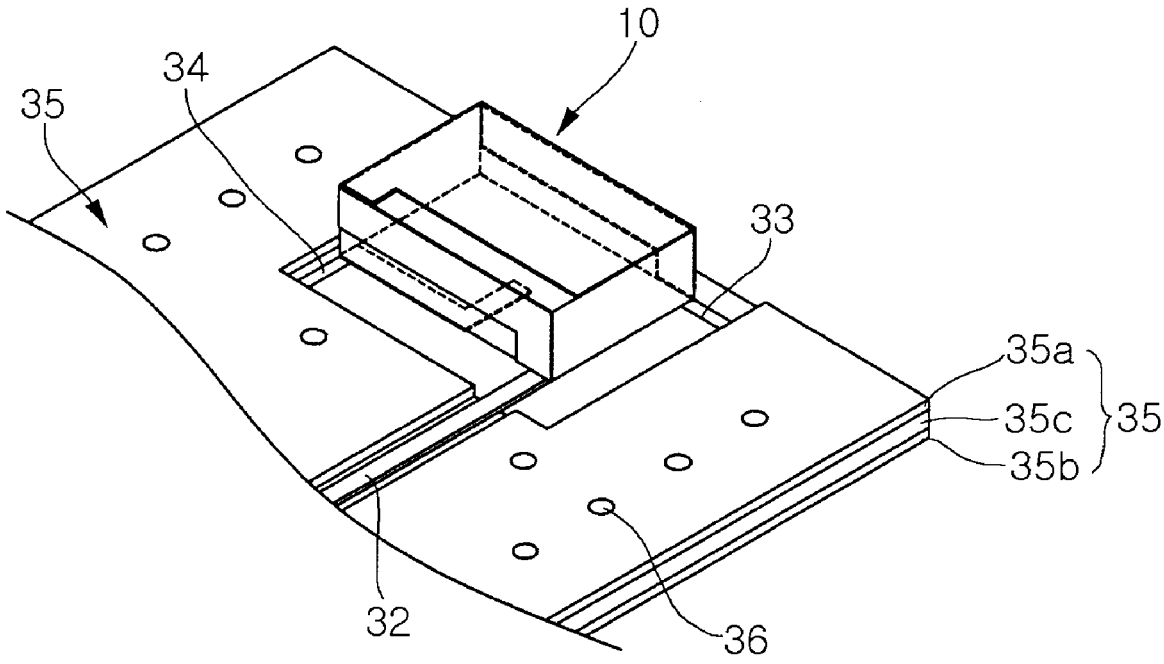
FIG. 3A is a perspective view and FIG. 3B is a rear view illustrating a board where a tuning ground pattern of a mobile telecommunication terminal is formed according to an exemplary embodiment of the invention.
Figure 3B:
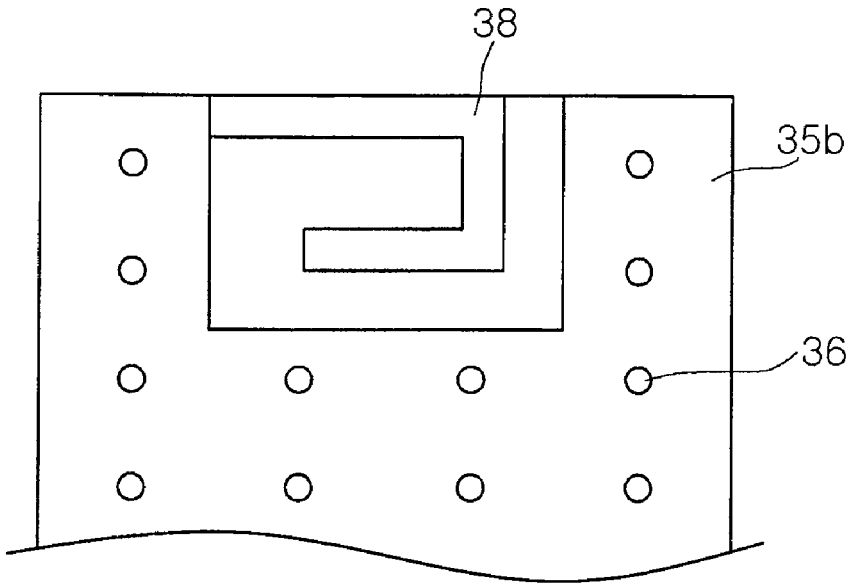

FIG. 3A is a perspective view and FIG. 3B is a rear view illustrating a board where a tuning ground pattern of a mobile telecommunication terminal is formed according to an exemplary embodiment of the invention.

Referring to FIGS. 3A and 3B, the board 35 having the chip antenna mounted thereon may include a dielectric layer 35*c* made of e.g., FR4 and ground parts 35*a* and 35*b* formed on both surfaces of the dielectric layer, respectively. The ground parts 35*a* and 35*b* are connected to each other by a plurality of via holes 36.

A chip antenna 10 is mounted on one surface of the board and may be formed on a portion of the dielectric layer 35*c* where the ground part 35*a* is not formed.

The chip antenna 10 of FIG. 3 is the one shown in FIG. 1. A first conductive pattern of the chip antenna receives a signal by a feeding part 32 formed on the board, and the second and third conductive patterns are connected to the ground part 35*a* by lines 33 and 34, respectively.

On a back surface of the surface of the board 35 where the chip antenna 10 is mounted, the ground part 35*b* is not formed on a portion corresponding to the mounting area of the chip antenna, and the dielectric layer 35*c* is directly exposed. A ground pattern 38 may be formed along an edge of the portion corresponding to the mounting area of the chip antenna on the exposed dielectric layer 35*c*. The ground pattern 38 may have one end connected to the ground part 35*b*.

The ground pattern 38 may have at least one bending to secure a predetermined length. The ground pattern 38 is capacitively coupled to a radiator of the chip antenna 10 mounted on the opposite surface of the board 35. Accordingly, the ground pattern 38 can be varied in length to adjust frequency characteristics of the antenna.

In the present embodiment, the ground pattern 38 is formed in an open square shape along an edge of the portion of the board corresponding to the mounting area of the chip antenna on the board 35, and has one end connected to the ground part 35*b*. To adjust the length of the ground pattern, the ground pattern may be cut partially from the open end thereof.

To facilitate tuning of the ground pattern, ruler markings may be formed on the ground pattern 38. In the present embodiment, the ruler markings have a spacing of 1 mm.

This ground pattern 38 with the ruler markings thereon easily enables tuning of frequency characteristics, which is essentially required for assembling the board with the chip antenna 10 thereon inside the mobile telecommunication terminal. That is, the ground pattern 38 can be adjusted in length to change a resonant frequency of the chip antenna 10, without re-designing the conductive pattern or dielectric block formed on the chip antenna 10.

Figure 4:
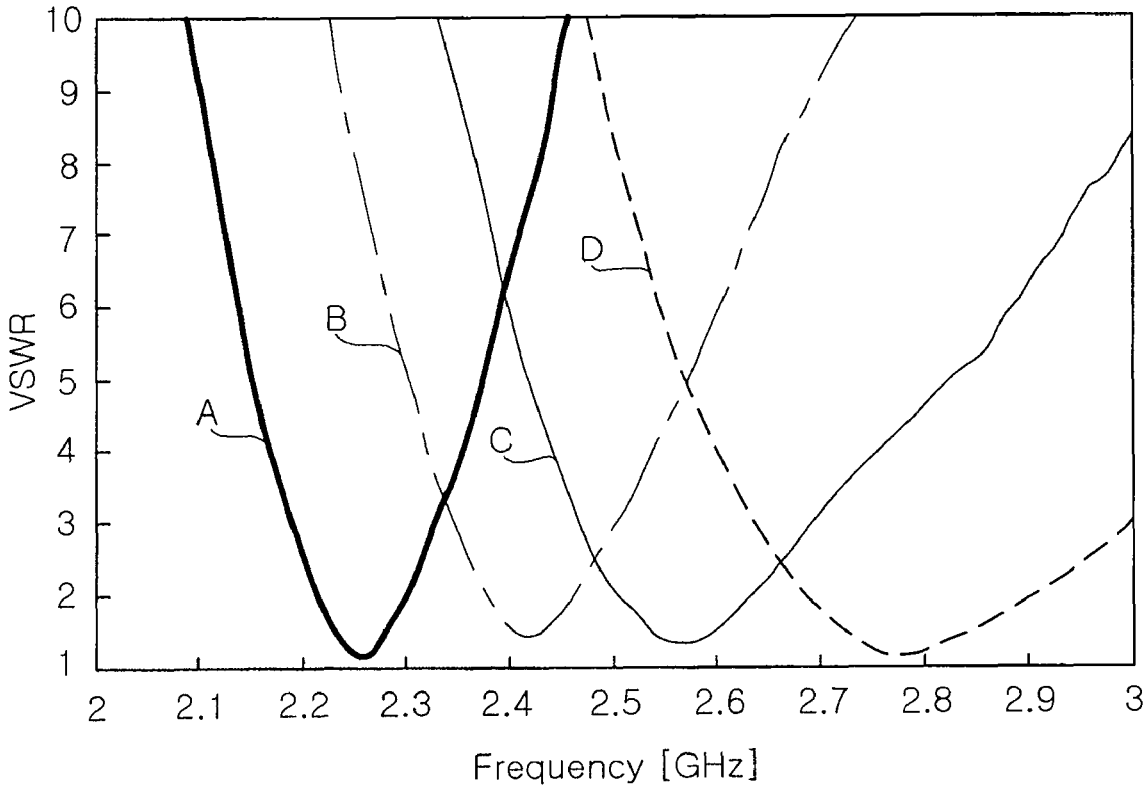
FIG. 4 is a graph illustrating a change in antenna characteristics with respect to a change in a length of a tuning ground pattern in the mobile telecommunication terminal shown in FIG. 3.

FIG. 4 is a graph illustrating a change in antenna characteristics with respect to a change in a length of a tuning ground pattern in the mobile telecommunication terminal shown in FIG. 3.

In the present embodiment, a chip antenna having first to third conductive patterns formed on a ceramic dielectric block with a size of 6×2×1.5 [$mm^3$] is mounted on a test board made of FR4 and with a size of 40×40×1.0 [$mm^3$]. Also, a tuning ground pattern with a length of 15 mm is formed on a rear surface of the board. Then, the tuning ground pattern is gradually decreased in length to plot changes in a resonant frequency of the antenna.

Referring to FIG. 4, the resonant frequency of the antenna is altered according to the length of the tuning ground pattern.

That is, in a case where the tuning ground pattern has a length of 8 mm (D), the resonant frequency is about 2.8 GHz. Also, the length of the tuning ground pattern is about 6 mm, 4 mm and 0 mm, the resonant frequency is about 2.55 GHz (C), 2.4 GHz (B), and 2.25 GHz (A), respectively. Based on these experimental results, in the present embodiment, a frequency of about 65 MHz is changed per 1 mm of the tuning ground pattern. As described above, according to the present embodiment, one chip antenna alone can cover a 2 GHz frequency band when installed in a terminal. Therefore, the chip antenna can be used in an industrial, scientific and medical (ISM) frequency band and a satellite-digital multimedia broadcasting (S-DMB) band.

Moreover, with a change in the length of the tuning ground pattern, the antenna has a resonant frequency changed but maintains the VSWR constant.

Although not illustrated, in the present embodiment, with regard to gain and radiation pattern according to the present embodiment, the antenna exhibits an average gain of at least −3 dBi at a bandwidth of 84 MHz around the resonant frequency before and after the ground pattern is removed.

As described above, the present invention is not limited to the aforesaid embodiments and attached drawings. That is, a shape of the dielectric block and shapes and arrangements of the conductive patterns may be variously modified.

As set forth above, according to exemplary embodiments of the invention, a chip antenna exhibits broadband characteristics and excellent antenna characteristics in a broadband frequency range. Also, a mobile telecommunication terminal includes the chip antenna and a board enabling easy tuning of frequency characteristics of the antenna when the chip antenna is assembled inside the mobile telecommunication terminal.

While the present invention has been shown and described in connection with the exemplary embodiments, it will be apparent to those skilled in the art that modifications and variations can be made without departing from the spirit and scope of the invention as defined by the appended claims.

What is claimed is:

1. A chip antenna, comprising:

a dielectric block having opposing top and bottom surfaces and a plurality of side surfaces connecting the top and bottom surfaces;

a first conductive pattern formed on at least one of the surfaces of the dielectric block and connected to an external feeding part;

a second conductive pattern formed on at least one of the surfaces of the dielectric block, connected to the first conductive pattern, and having one end connected to an external ground part; and a third conductive pattern formed on at least one of the surfaces of the dielectric block, and spaced apart from the first and second conductive patterns at a predetermined distance to be capacitively coupled to the first and second conductive patterns, respectively, the third conductive pattern having a lower end connected to the external ground part;

wherein the dielectric block is shaped as a rectangular parallelepiped, the first and second conductive patterns define a radiator, and the radiator is formed across a first side surface parallel to a longitudinal direction of the dielectric block, the top surface, and a second side surface opposing the first side surface of the dielectric block.

2. The chip antenna of claim 1, wherein the first conductive pattern is formed on the first side surface parallel to the longitudinal direction of the dielectric block.

3. The chip antenna of claim 2, wherein the first conductive pattern has an upper end in contact with an intersecting line between the first side surface and the top surface of the dielectric block.

4. The chip antenna of claim 3, wherein the first conductive pattern is L-shaped.

5. The chip antenna of claim 1, wherein the second conductive pattern is formed on the second side surface opposing the first side surface and on the top surface of the dielectric block.

6. The chip antenna of claim of claim 5, wherein the second conductive pattern comprises a contact portion of a predetermined length in contact with the first conductive pattern, and another portion outside the contact portion and spaced apart from the first conductive pattern at a predetermined distance.

7. The chip antenna of claim 1, wherein the third conductive pattern is formed on the bottom surface of the dielectric block.

8. The chip antenna of claim 7, wherein the third conductive pattern has the lower end in contact with an intersecting line between the bottom surface and the first side surface of the dielectric block, and has at least one bending.

9. The chip antenna of claim 1, wherein the first conductive pattern is formed on the first side surface of the dielectric block and has an L shape such that an upper end of the first conductive pattern is in contact with an intersecting line between the first side surface and the top surface of the dielectric block, the second conductive pattern is formed at a predetermined distance from the intersecting line between the top surface and the first side surface of the dielectric block, except for a contact portion in contact with the first conductive pattern, and the third conductive pattern is formed on the bottom surface of the dielectric block, has the lower end in contact with an intersecting line between the bottom surface and the first side surface of the dielectric block, and has one bending.

10. A mobile telecommunication terminal, comprising:

a chip antenna comprising:

a dielectric block having opposing top and bottom surfaces and a plurality of side surfaces connecting the top and bottom surfaces;

a first conductive pattern formed on at least one of the surfaces of the dielectric block and connected to a feeding part;

a second conductive pattern formed on at least one of the surfaces of the dielectric block, connected to the first conductive pattern, and having one end connected to a ground part; and a third conductive pattern formed on at least one of the surfaces of the dielectric block, and spaced apart from the first and second conductive patterns at a predetermined distance to be capacitively coupled to the first and second conductive patterns, respectively, the third conductive pattern having a lower end connected to the ground part; and a printed circuit board having the chip antenna mounted on one surface thereof, the printed circuit board comprising a tuning ground pattern for tuning frequency characteristics of the chip antenna;

wherein said tuning ground pattern is formed on another surface opposing the one surface of the printed circuit board and has one end connected to the ground part.

11. The mobile telecommunication terminal of claim 10, wherein the tuning ground pattern has an open-square shape defined along an edge of a mounting area of the chip antenna.

12. The mobile telecommunication terminal of claim 11, wherein the tuning ground pattern has ruler markings to facilitate tuning.

13. The mobile telecommunication terminal of claim 10, wherein the dielectric block is shaped as a rectangular parallelepiped.

14. The mobile telecommunication terminal of claim 13, wherein the first conductive pattern and the second conductive pattern are connected together to define a radiator, and the radiator is formed across a first side surface parallel to a longitudinal direction of the dielectric block, the top surface, and a second side surface opposing the first side surface of the dielectric block.

15. The mobile telecommunication terminal of claim 14, wherein the first conductive pattern is formed on the first side surface parallel to the longitudinal direction of the dielectric block.

16. The mobile telecommunication terminal of claim 15, wherein the first conductive pattern has an upper end in contact with an intersecting line between the first side surface and the top surface of the dielectric block.

17. The mobile telecommunication terminal of claim 16, wherein the first conductive pattern is L-shaped.

18. The mobile telecommunication terminal of claim 14, wherein the second conductive pattern is formed on the second side surface opposing the first side surface and on the top surface of the dielectric block.

19. The mobile telecommunication terminal of claim 18, wherein the second conductive pattern comprises a contact portion of a predetermined length in contact with the first conductive pattern, and another portion outside the contact portion and spaced apart from the first conductive pattern at a predetermined distance.

20. The mobile telecommunication terminal of claim 14, wherein the third conductive pattern is formed on the bottom surface of the dielectric block.

21. The mobile telecommunication terminal of claim 20, wherein the third conductive pattern has the lower end in contact with an intersecting line between the bottom surface and the first side surface of the dielectric block, and has at least one bending.

22. The mobile telecommunication terminal of claim 14, wherein the tuning ground pattern has an open-square shape defined along an edge of a mounting area of the chip antenna, the first conductive pattern is formed on the first side surface of the dielectric block and has an L shape such that an upper end of the first conductive pattern is in contact with an intersecting line between the first side surface and the top surface of the dielectric block, the second conductive pattern is formed at a predetermined distance from the intersecting line between the top surface and the first side surface of the dielectric block, except for a contact portion in contact with the first conductive pattern, and the third conductive pattern is formed on the bottom surface of the dielectric block, has the lower end in contact with an intersecting line between the bottom surface and the first side surface of the dielectric block, and has one bending.

* * * * *